US010796677B2

(12) United States Patent
Matsuno

(10) Patent No.: US 10,796,677 B2
(45) Date of Patent: Oct. 6, 2020

(54) ELECTRONIC MUSICAL INSTRUMENT AND AUTOMATIC POWER-OFF METHOD

(71) Applicant: YAMAHA CORPORATION, Hamamatsu-shi (JP)

(72) Inventor: Koichi Matsuno, Fukuroi (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/547,849

(22) Filed: Aug. 22, 2019

(65) Prior Publication Data

US 2019/0378484 A1 Dec. 12, 2019

Related U.S. Application Data

(63) Continuation of application No. PCT/JP2018/008341, filed on Mar. 5, 2018.

(30) Foreign Application Priority Data

Mar. 7, 2017 (JP) ..... 2017-042663

(51) Int. Cl.
*G10H 1/18* (2006.01)

(52) U.S. Cl.
CPC ..... *G10H 1/18* (2013.01); *G10H 2240/211* (2013.01)

(58) Field of Classification Search
CPC ..... G10H 1/18; G10H 2240/211
(Continued)

(56) References Cited

U.S. PATENT DOCUMENTS 4,281,283 A * 7/1981 Ross ..... G01R 31/50 324/556
4,344,347 A * 8/1982 Faulkner ..... G10H 1/0575 708/277

(Continued)

FOREIGN PATENT DOCUMENTS

EP 3125232 A1 * 2/2017 ..... G06F 1/32
JP S57142415 A 9/1982

(Continued)

OTHER PUBLICATIONS

English Translation for the Written Opinion of the International Searching Authority on JP/PCT2018/008341, dated May 22, 2018 (Year: 2018).*

(Continued)

*Primary Examiner* — David S Warren
*Assistant Examiner* — Christina M Schreiber
(74) *Attorney, Agent, or Firm* — Rossi, Kimms & McDowell LLP

(57) ABSTRACT

An electronic musical instrument includes a condition determiner that determines whether an OFF condition for turning off a power supply is satisfied in an automatic power-OFF mode; a noise gate that is opened when a level of an input audio signal exceeds a threshold value and is closed when the level of the input audio signal continues being equal to or lower than the threshold value for a first predetermined period of time; and a controller that turns off the power supply on the condition that the condition determiner determines that the OFF condition is satisfied in the automatic power-OFF mode; and the controller does not turn off the power supply when the noise gate is in an open state, even in the case where the OFF condition is satisfied.

11 Claims, 5 Drawing Sheets

(58) Field of Classification Search
USPC ..... 84/653
See application file for complete search history.

(56) References Cited

U.S. PATENT DOCUMENTS

| | | | | |
|---|---|---|---|---|
| 8,553,908 | B2 * | 10/2013 | Sugihara | H03F 3/181 381/107 |
| 9,871,530 | B1 * | 1/2018 | La Grou | H03M 1/188 |
| 2015/0263688 | A1 * | 9/2015 | Nicolino, Jr. | H04R 1/1041 381/57 |
| 2019/0378484 | A1 * | 12/2019 | Matsuno | G10H 7/002 |
| 2019/0379977 | A1 * | 12/2019 | Buttner | G06N 7/02 |

FOREIGN PATENT DOCUMENTS

| | | | |
|---|---|---|---|
| JP | H11149288 | A | 6/1999 |
| JP | 2003140652 | A | 5/2003 |
| JP | 2007086214 | A | 4/2007 |
| JP | 2008304750 | A | 12/2008 |
| JP | 2011166736 | A | 8/2011 |
| JP | 2016050977 | A | 4/2016 |

OTHER PUBLICATIONS

International Search Report issued in Intl. Appln. No. PCT/JP2018/008341 dated May 22, 2018. English translation provided.
Written Opinion issued in Intl. Appln. No. PCT/JP2018/008341 dated May 22, 2018.

* cited by examiner

ELECTRONIC MUSICAL INSTRUMENT AND AUTOMATIC POWER-OFF METHOD

BACKGROUND OF THE INVENTION

Field of the Invention

The present invention relates to an electronic musical instrument in which an audio signal can be input and an automatic power-off method of an electronic musical instrument.

Description of Related Art

Conventionally, electronic musical instruments that can convert audio signals input from external equipment into sound have been known. For example, an electronic keyboard musical instrument described in JP 2016-50977 A imports an audio signal into a DSP (Digital Signal Processor), applies effects and outputs a sound, whereby the electronic musical instrument can be utilized not only as a musical instrument but also as an audio device. Since the input audio signal includes noise, the musical instrument described in JP 2016-50977 A has a noise gate arranged at the input portion of the DSP. The noise gate is opened and closed based on a predetermined threshold level. In the case where an externally input audio signal is converted into a sound using such a musical instrument, operators might not be operated for a long time.

Meanwhile, there is an electronic musical instrument that has an automatic power-OFF mode for turning off the power supply of the device automatically on the condition that none of the operators is operated in a certain period of time, etc. In the situation where the musical instrument is mainly used as an audio device, and the automatic power-OFF mode is set, when a user continues listening to the sound based on the audio signal without operating the operators, the power supply might be turned off although the audio signal is being input.

On the other hand, the technique for detecting an input of a wireless signal and controlling a power supply has been known (see JP 2003-140652 A and JP 2007-86214 A, for example). It is considered that the mechanism for directly detecting presence or absence of an input of an audio signal is provided by application of this technique, and a power supply is controlled not to be turned off when a signal is being input.

BRIEF SUMMARY OF THE INVENTION

However, when the dedicated mechanism for directly detecting presence or absence of an input of an audio signal is provided, the configuration becomes complicated.

The present invention has been made to solve the problems with the above-mentioned prior art, and the object of the present invention is to provide an electronic musical instrument and an automatic power-off method that can prevent a power supply from being turned off automatically when an audio signal is being input, with a simple configuration.

In order to achieve the above-mentioned purpose, an electronic musical instrument according to one aspect of the present invention includes a condition determiner that determines whether an OFF condition for turning off a power supply is satisfied in an automatic power-OFF mode, a noise gate that is opened when a level of an input audio signal exceeds a threshold value and is closed when the level of the input audio signal continues being equal to or lower than the threshold value for a first predetermined period of time, and a controller that turns off the power supply on the condition that the condition determiner determines that the OFF condition is satisfied in the automatic power-OFF mode, wherein the control means does not turn off the power supply when the noise gate is in an open state, even in the case where the OFF condition is satisfied.

In an embodiment, the audio signal may be input by being received by wireless communication. In an embodiment, the audio signal may be input by being received by short-range wireless communication.

In an embodiment, the OFF condition may be satisfied when no operator of the electronic musical instrument continues being operated for a second predetermined period of time.

In an embodiment, the OFF condition may be satisfied when a third predetermined period of time elapses from a time when the noise gate is opened.

An electronic musical instrument according to another aspect of the present invention includes a noise gate that is opened when a level of an input audio signal exceeds a threshold value and is closed when the level of the input audio signal continues being equal to or lower than the threshold value for a first predetermined period of time; and a processor that is configured to determine whether an OFF condition for turning off a power supply is satisfied in an automatic power-OFF mode, and turn off the power supply on the condition that it is determined that the OFF condition is satisfied in the automatic power-OFF mode, wherein the processor is configured not to turn off the power supply when the noise gate is in an open state, even in the case where the OFF condition is satisfied.

An automatic power off method of an electronic musical instrument according to yet another aspect of the present invention includes determining whether an OFF condition for turning off a power supply is satisfied in an automatic power-OFF mode; inputting an audio signal into the electronic musical instrument via a noise gate that is opened when a level of an input audio signal exceeds a threshold value and is closed when the level of the input audio signal continues being equal to or lower than the threshold value for a first predetermined period of time; and turning off the power supply on the condition that it is determined that the OFF condition is satisfied in the automatic power-OFF mode, wherein the turning off the power supply includes not turning off the power supply when the noise gate is in an open state, even in the case where the OFF condition is satisfied.

In an embodiment, the audio signal may be input by being received by communication, and the turning off the power supply may include turning off the power supply regardless of the open state or a close state of the noise gate when external equipment that has an established connection using the communication is not present, in the case where the OFF condition is satisfied in the automatic power-OFF mode.

In an embodiment, the OFF condition may be satisfied when no operator of the electronic musical instrument continues being operated for a second predetermined period of time.

In an embodiment, the OFF condition may be satisfied when a third predetermined period of time elapses from a time when the noise gate is opened.

Other features, elements, characteristics, and advantages of the present invention will become more apparent from the following description of preferred embodiments of the present invention with reference to the attached drawings.

DESCRIPTION OF THE PREFERRED EMBODIMENTS

Embodiments of the present invention will be mentioned below with reference to the drawings.

Figure 1:
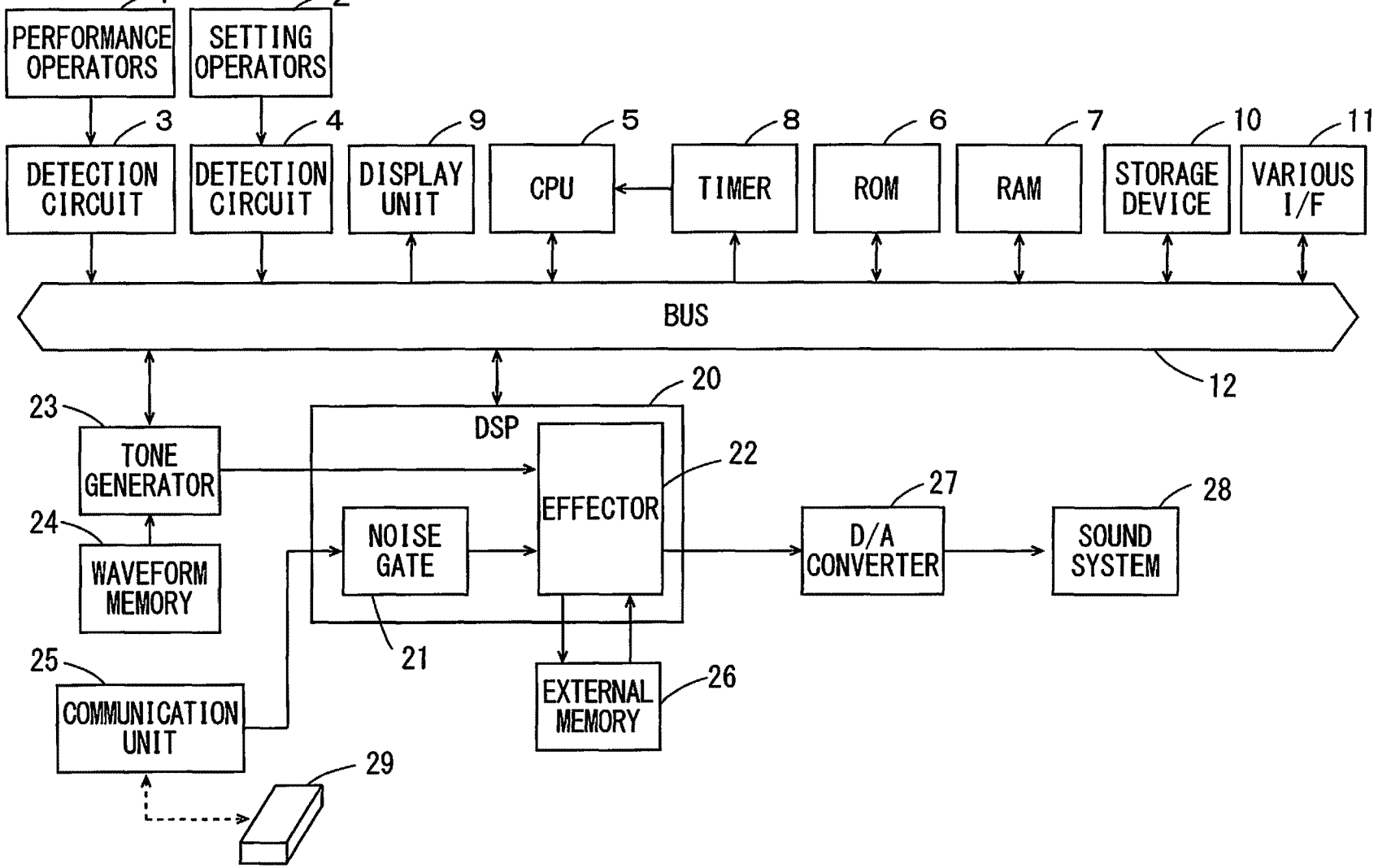
FIG. 1 is a block diagram of an electronic musical instrument according to one embodiment of the present invention.

FIG. 1 is a block diagram of an electronic musical instrument according to one embodiment of the present invention. While this electronic musical instrument is configured as an electronic keyboard musical instrument, for example, the type of the musical instrument is not limited. This electronic musical instrument comprises a detection circuit 3, a detection circuit 4, a ROM (Read Only Memory) 6, a RAM (Random Access Memory) 7, a timer 8, a display 9, a storage device 10, various interfaces (I/F) 11, a tone generator 23 and a DSP 20 as constituent elements. Further, in this electronic musical instrument, each constituent element is connected to a CPU (Central Processing Unit) 5 via a bus 12. Furthermore, performance operators 1 including a keyboard, pedals and effects operators are connected to the detection circuit 3. Setting operators 2 for inputting various information are connected to the detection circuit 4. The display 9 displays various information. The timer 8 is connected to the CPU 5. Various I/Fs 11 include MIDI interfaces, wireless interfaces and wired interfaces.

A DSP 20 includes an effector 22 and a noise gate 21. A D/A converter 27 and a sound system 28 (an amplifier, a speaker and the like) are connected to the effector 22 in series. Further, an external memory 26 is connected to the effector 22. A waveform memory 24 is connected to the tone generator 23. A communication unit 25 is connected to an input portion of the noise gate 21. The communication unit 25 can transmit and receive a signal using the Bluetooth (registered trademark), which is one of short-range wireless communication. The communication unit 25 can wirelessly receive an audio signal from external equipment 29, for example, and the audio signal is input in the DSP 20 via the noise gate 21.

The detection circuit 3 detects operation states of the performance operators 1, and the detection circuit 4 detects operation states of the setting operators 2. The CPU 5 controls the entire present device. The ROM 6 stores control programs to be executed by the CPU 5, various table data, etc. The RAM 7 temporarily stores various input information such as performance data and text data, various flags, buffer data, results of arithmetic operations, etc. The timer 8 measures various times such as an interrupt time in timer interrupt processing. The storage device 10 stores various application programs including the above-mentioned control program, various music piece data, various data, etc.

The musical performance data input from the performance operators 1 and preset musical performance data are transmitted to the tone generator 23, and the tone generator 23 produces sound data by reading waveform data from the waveform memory 24. The effector 22 of the DSP 20 applies acoustic effects to the sound data that is output from the tone generator 23. In this case, the effector 22 of the DSP 20 controls the external memory 26. Specifically, the effector 22 performs specific processing on the sound data that is input from the tone generator 23 and writes the processed sound data in the external memory 26 as sampling data. Further, the effector 22 reads the sampling data from the external memory 26 and outputs the sampling data as sound data. The sound data with the applied acoustic effects, which is output from the DSP 20, is input in the D/A converter 27 and converted into an analog signal. This analog signal is output from the sound system 28. The noise gate 21 is provided in an input portion in the DSP 20, and cancels the noises included in the audio signal when importing the signal into the DSP 20.

This electronic musical instrument can not only generate a sound based on normal real-time performance or musical performance data, but also generate a sound based on an audio signal that is input in the DSP 20. It is also possible for a user to allow this electronic musical instrument to generate a sound based on only an audio signal and use this electronic musical instrument as an audio device. In this case, if the user operates the performance operators 1, a sound is also generated based on musical performance while being overlapped with the sound generated based on the audio signal.

Figure 2:
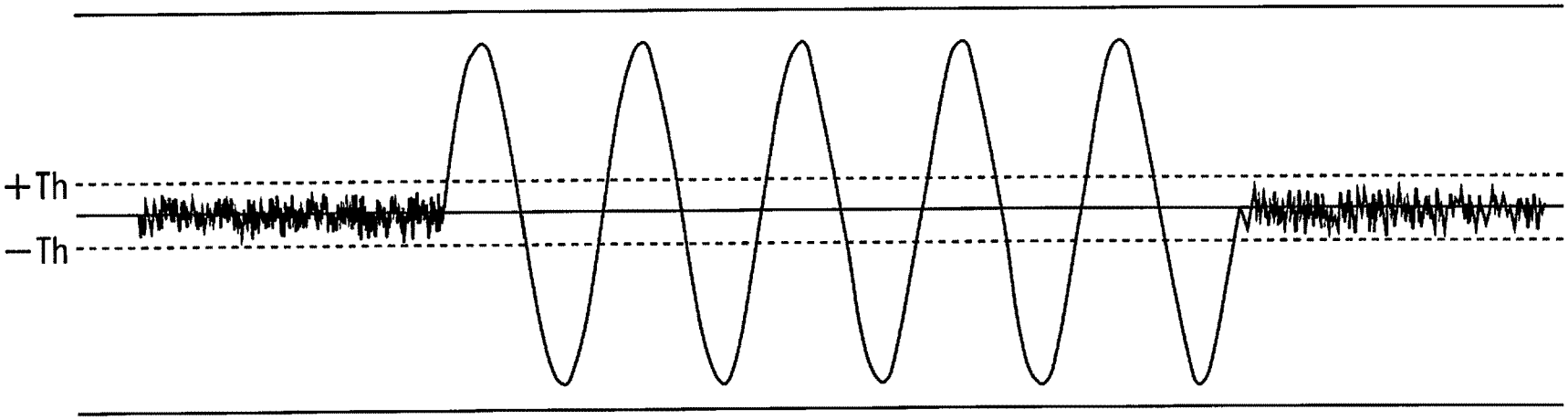
FIG. 2 is a waveform diagram of an audio signal that is input in a noise gate.

FIG. 2 is a waveform diagram of an audio signal that is input in the noise gate 21. The noise gate 21 is opened when an absolute value of the level of the input audio signal exceeds a threshold value Th, and is closed when the absolute value of the level of the input audio signal continues being equal to or lower than the threshold value Th for a first predetermined period of time T1. Noises having small amplitudes that fall within the range determined by the threshold values Th are canceled by the noise gate 21. Thus, a sound can be generated based on an audio signal only when the noise gate 21 is opened.

Main processing to be performed when the power supply of this electronic musical instrument is turned on will be described. First, the CPU 5 performs initialization and sets various set values to default values. In this case, the CPU 5 also performs processing of establishing a communication connection with the external equipment 29 via the communication unit 25. While communication connections may be established with a plurality sets of the external equipment 29, no communication connection may be established with the external equipment 29. Further, even after the main processing is started, the processing of establishing a connection is performed at any time in response to a request from the external equipment 29 or an instruction given by the user to this electronic musical instrument. Thereafter, the CPU 5 receives an instruction given by the setting operators 2 (panel processing) and executes the setting of the equipment. In this panel processing, forcible power-OFF is also executed in accordance with an instruction given by the user as well as execution of setting or canceling of an "automatic power-OFF mode." The automatic power-OFF mode is the mode in which the power supply of the electronic musical instrument is turned off automatically on the condition that an "OFF condition" is satisfied. Here, as one example of the OFF condition, the OFF condition is satisfied when all of the operators (the performance operators 1 and the setting operators 2) of the electronic musical instrument continue not being operated for a second predetermined period of time T2. Next, the CPU 5 produces an analogue signal to perform sound generation processing. In this sound generation processing, at least any one of generation of a sound by real-time performance, generation of a sound by musical performance data and generation of a sound by an audio signal is executed depending on an operation mode.

Figure 3:
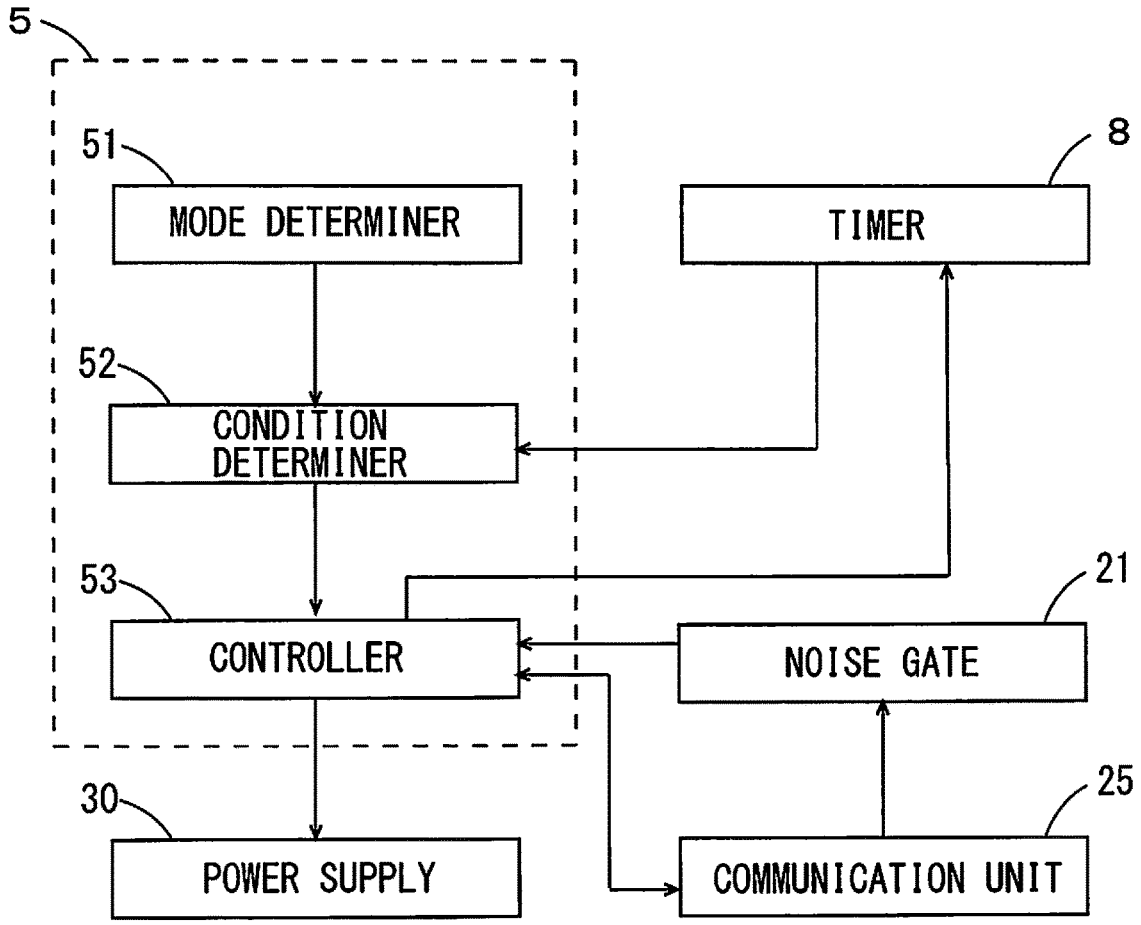
FIG. 3 is a block diagram showing functional blocks realized by a CPU.

FIG. 3 is a block diagram showing functional blocks realized by the CPU. The CPU 5 executes the program stored in the ROM 6, whereby a mode determiner 51, a condition determiner 52 and a controller 53 as shown in FIG. 3 are realized. The respective functional blocks (51 to 53) shown in FIG. 3 may be realized by hardware such as electronic circuits.

The mode determiner 51 determines whether the automatic power-OFF mode is set. The condition determiner 52 determines determines whether the OFF condition for turning off the power supply 30 is satisfied in the automatic power-OFF mode. The controller 53 turns off the power supply 30 on the condition that the condition determiner 52 determines that the OFF condition is satisfied in the automatic power-OFF mode. In this case, the controller 53 does not turn off the power supply 30 when the noise gate 21 is in an open state, even in the case where the OFF condition is satisfied.

Figure 4:
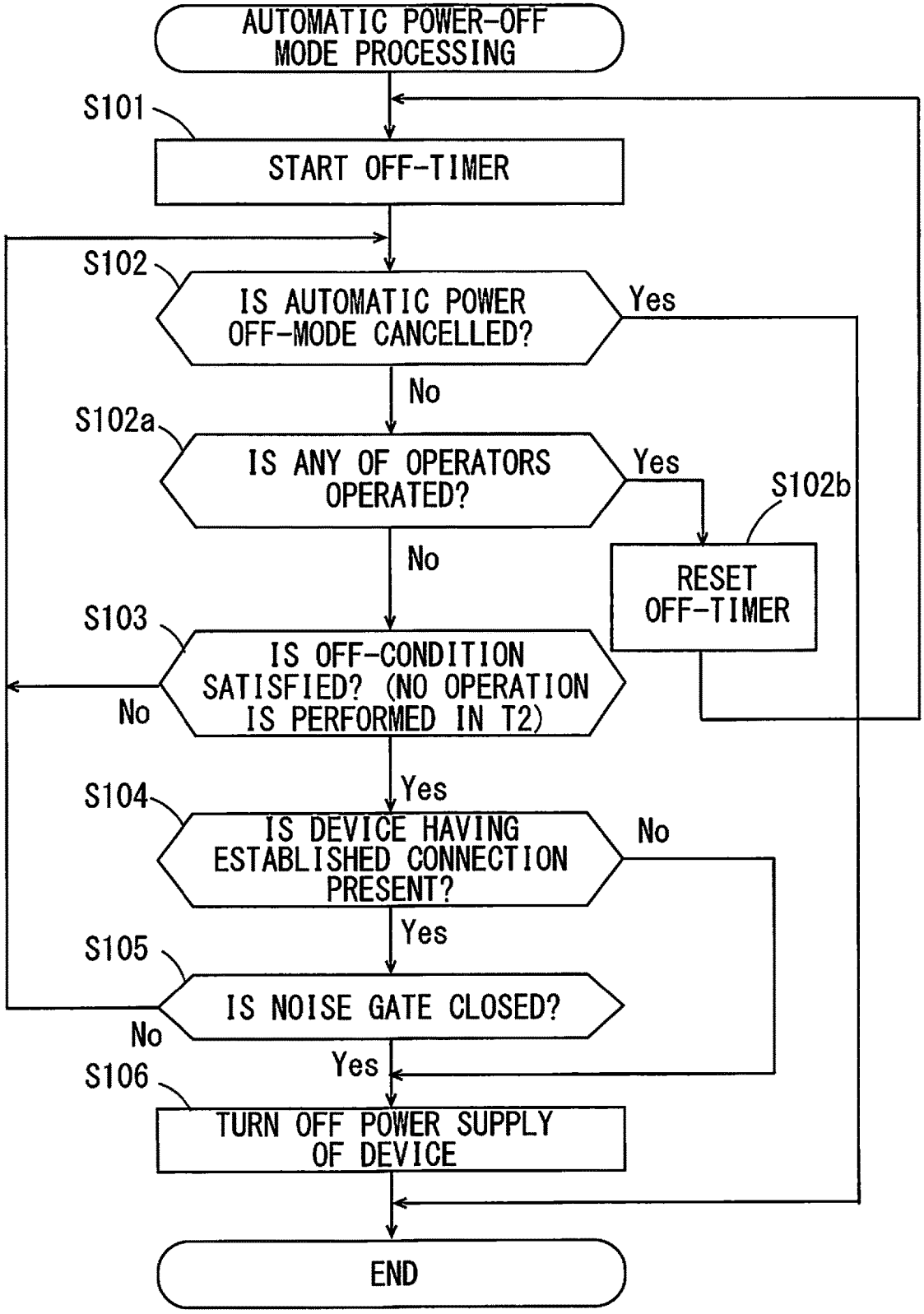
FIG. 4 is a flow chart of automatic power-OFF mode processing.

FIG. 4 is a flow chart of the automatic power-OFF mode processing. This processing is implemented when the CPU 5 reads the program stored in the ROM 6 and executes the program. This processing is started when the automatic power-OFF mode is set.

First, the CPU 5 causes the timer 8 to start measuring the time of an OFF timer (step S101). Next, the CPU 5 determines whether the automatic power-OFF mode is canceled (step S102). When the automatic power-OFF mode is cancelled, the CPU 5 ends the processing of FIG. 3. On the other hand, when the automatic power-OFF mode is not cancelled, the CPU 5 determines whether any of the performance operators 1 and the setting operators 2 is operated (step S102*a*). In the case where any of the performance operators 1 and the setting operators 2 has not been operated at all, the CPU 5 determines whether the OFF condition is satisfied (step S103). Here, whether the OFF condition is satisfied or not is determined based on whether the time measured by the OFF timer has reached the second predetermined period of time T2. Therefore, the OFF condition is satisfied in the case where any of the performance operators 1 and the setting operators 2 has not been operated at all from the time when the automatic power-OFF mode is set. Furthermore, the OFF timer is reset (step 102*b*) each time any of the performance operators 1 and the setting operators 2 is operated in the step S102*a*, and the processing returns to the step S101, so that the OFF-timer restarts measuring the time. Therefore, the OFF condition is also satisfied in the case where the second predetermined period of time T2 elapses from the time when any of the performance operators 1 and the setting operators 2 is last operated.

Furthermore, when the OFF condition is not satisfied, it is appropriate to keep the power supply 30 of the device ON. Thus, the CPU 5 returns to the step S102. When the OFF condition is satisfied, the CPU 5 determines whether the equipment (the external equipment 29) having an established connection via the connection unit 25 is present (step S104). As a result of determination, when there is no equipment having an established communication, the CPU 5 turns off the power supply 30 of the electronic musical instrument (step S106) since it can be determined that an audio signal is not being received by the communication unit 25, and ends the processing of FIG. 4. Thus, the below-mentioned determination processing of the step S105 can be skipped, and the processing can be more quickly performed. On the other hand, when equipment having an established communication is present, the CPU 5 determines whether the noise gate 21 is closed (step S105). As a result of determination, when the noise gate 21 is opened, the CPU 5 returns to the step S102 since it can be determined that an audio signal is being input. Thus, the power supply 30 of the device can be prevented from being turned off automatically when an audio signal is being input. On the other hand, when the noise gate 21 is closed, the CPU 5 turns off the power supply 30 of the electronic musical instrument (step S106) since it can be determined that an audio signal is not being input, and ends the processing of FIG. 3.

In the present embodiment, even in the case where the CPU 5 determines that the OFF condition is satisfied in the automatic power-OFF mode, the CPU 5 does not turn off the power supply 30 of the device when the noise gate 21 is opened. Thus, the power supply 30 of the device can be prevented from being turned off automatically when an audio signal is being input. Moreover, since the presence or absence of the input of an audio signal is not detected directly but is determined based on the open state or the close state of the noise gate 21, the configuration can be simple. Further, when an audio signal is not input but only noises having small amplitudes are input, the noise gate 21 is closed. Therefore, when the OFF condition is satisfied, the power supply 30 of the device is turned off. Thus, when only the noises are input, the power supply 30 of the device can be prevented from being kept on wastefully. Furthermore, when the OFF condition is satisfied, and no external equipment has an established connection, the power supply 30 of the device is turned off regardless of the open state or the close state of the noise gate 21. Therefore, the processing can be performed quickly.

Further, the OFF condition is satisfied when all of the operators of the electronic musical instrument continue not being operated for the second predetermined period of time T2. Therefore, the power supply 30 is not turned off for the second predetermined period of time T2 from the time when any of the operators is operated. Thus, when the user restarts musical performance using any of the operators before the long time elapses after an operation of any of the operators ends, it is not necessary to turn on the power supply 30 of the device from the off state, which can prevent the user from waiting.

Figure 5:
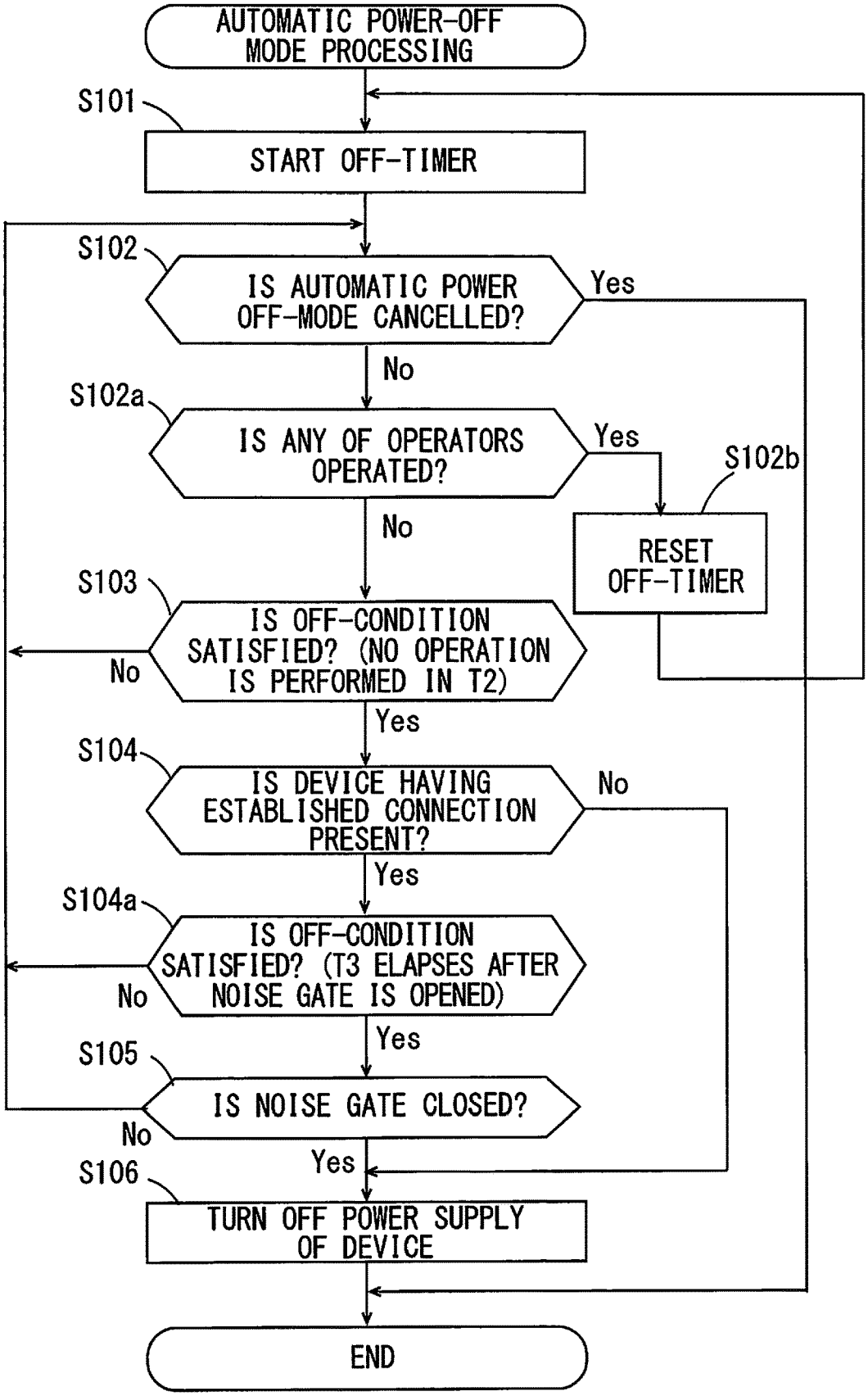
FIG. 5 is a flow chart showing another example of the automatic power-OFF mode processing.

The OFF condition is not limited to the condition described in the example. As shown in FIG. 5, for example, the OFF condition may be satisfied when a third predetermined period of time T3 elapses from the time when the noise gate 21 is opened.

In an example of FIG. 5, another OFF timer starts measuring the time when the noise gate 21 is opened. In the step S104*a* which is the next step of the step S104, the CPU 5 determines whether the third predetermined period of time T3 elapses from the time when the noise gate 21 is opened. When the third predetermined period of time T3 does not elapses from the time when the noise gate 21 is opened, the CPU 5 returns to the step S102. When the third predetermined period of time T3 elapses from the time when the noise gate 21 is opened, the CPU 5 determines whether the noise gate 21 is closed. When the noise gate 21 is opened, the CPU 5 returns to the step S102 (step S105). When the noise gate 21 is closed, the CPU 5 turns off the power supply 30 of the electronic musical instrument (step S106).

Therefore, the power supply 30 is not turned off until a certain time elapses from the time when an audio signal is input, and the input of the audio signal is treated similarly to an operation of any of the operators. On the other hand, even in the case where the OFF condition is satisfied when the third predetermined period of time T3 elapses from the time when the noise gate 21 is opened, the power supply 30 is not turned off unless the noise gate 21 is closed. Thus, even when the OFF condition is satisfied, the power supply 30 of the device is not turned off as long as an audio signal continues being input, and this electronic musical instrument can be prevented from abruptly stopping generating a sound. In this case, the third predetermined period of time may have the same value as the second predetermined period of time T2. Alternatively, the OFF condition may be satisfied when the second predetermined period of time T2 elapses from the later one of the time point at which the noise gate 21 is last opened and the time point at which any of the operators is last operated.

While the communication unit 25 is in compliance with the Bluetooth (registered trademark) standards, the present invention is not limited to this. The communication unit 25 may be in compliance with another short-range wireless communication. Further, the communication unit 25 may be configured to be capable of receiving an audio signal, and may be configured to receive an audio signal via a wired connection. Therefore, the configurations for a line input and a microphone input are included. In the case of the line input, whether a plug is inserted into a terminal may be detected, the result of detection may be treated similarly to the result of determination whether the noise gate 21 is in the open state, and the power supply 30 may be controlled.

Although the present invention has been described based on preferred embodiments, the present invention is not limited to those, and various embodiments can be included without departing from the scope of the present invention.

While the electronic musical instrument is connected to the external equipment 29 by wireless communication and receives an audio signal from the external equipment 29 by wireless communication in the above-mentioned embodiment, for example, the electronic musical instrument may be connected to the external equipment 29 by wired communication, and an audio signal may be supplied from the external equipment 29 to the electronic musical instrument by wired communication. In this case, in the step S104, it is determined whether equipment having an established wired connection is present. Further, an audio signal may be connected to the Internet or clouds, and the audio device may be downloaded from the Internet or clouds. In this case, in the step S104, it is determined whether the electronic musical instrument has an established connection with the Internet or clouds.

As above-mentioned description, according to the above embodiments, the power supply can be prevented from being turned off automatically when an audio signal is being input, with a simple configuration. Further, according to the above embodiments, the processing can be performed quickly. Further, according to the above embodiments, the power supply is prevented from being turned off for a certain time from the time when any of operators is operated, and the power supply is prevented from being turned off for a certain time from the time when an audio signal is input.

The present application claims priority based on Japanese patent application No. 2017-042663, filed on Mar. 7, 2017 and the entire contents of the Japanese patent application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. An electronic musical instrument comprising:

a condition determiner that determines whether an OFF condition for turning off a power supply is satisfied in an automatic power-OFF mode;

a noise gate that is opened when a level of an input audio signal exceeds a threshold value and is closed when the level of the input audio signal continues being equal to or lower than the threshold value for a first predetermined period of time; and a controller that turns off the power supply on the condition that the condition determiner determines that the OFF condition is satisfied in the automatic power-OFF mode, wherein the controller does not turn off the power supply when the noise gate is in an open state, even in the case where the OFF condition is satisfied.

2. The electronic musical instrument as recited in claim 1, wherein the input audio signal is received from an external device, and the controller turns off the power supply regardless of the open state or a closed state of the noise gate in a case where (i) an established connection with the external device no longer exists and (ii) the OFF condition is satisfied in the automatic power-OFF mode.

3. The electronic musical instrument as recited in claim 2, wherein the input audio signal is received by wireless communication.

4. The electronic musical instrument as recited in claim 2, wherein the input audio signal is received by short-range wireless communication.

5. The electronic musical instrument as recited in claim 1, wherein the OFF condition is satisfied when no operator of the electronic musical instrument is operated for a second predetermined period of time.

6. The electronic musical instrument as recited in claim 1, wherein the OFF condition is satisfied when a third predetermined period of time elapses from a time when the noise gate is opened.

7. An electronic musical instrument comprising:

a noise gate that is opened when a level of an input audio signal exceeds a threshold value and is closed when the level of the input audio signal continues being equal to or lower than the threshold value for a first predetermined period of time; and a processor that is configured to determine whether an OFF condition for turning off a power supply is satisfied in an automatic power-OFF mode, and turn off the power supply on the condition that it is determined that the OFF condition is satisfied in the automatic power-OFF mode, wherein the processor is configured not to turn off the power supply when the noise gate is in an open state, even in the case where the OFF condition is satisfied.

8. An automatic power off method of an electronic musical instrument comprising:

determining whether an OFF condition for turning off a power supply is satisfied in an automatic power-OFF mode;

inputting an audio signal into the electronic musical instrument via a noise gate that is opened when a level of an input audio signal exceeds a threshold value and is closed when the level of the input audio signal continues being equal to or lower than the threshold value for a first predetermined period of time; and turning off the power supply on the condition that it is determined that the OFF condition is satisfied in the automatic power-OFF mode, wherein the turning off the power supply includes not turning off the power supply when the noise gate is in an open state, even in the case where the OFF condition is satisfied.

9. The automatic power off method of electronic musical instrument as recited in claim 8, wherein the input audio signal is received from an external device, and the turning off the power supply includes turning off the power supply regardless of the open state or a closed state of the noise gate in a case where (i) an established connection with the external device no longer exists and (ii) the OFF condition is satisfied in the automatic power-OFF mode.

10. The automatic power off method of an electronic musical instrument as recited in claim 8, wherein the OFF condition is satisfied when no operator of the electronic musical instrument is operated for a second predetermined period of time.

11. The automatic power off method of an electronic musical instrument as recited in claim 8, wherein the OFF condition is satisfied when a third predetermined period of time elapses from a time when the noise gate is opened.

* * * * *